US010577153B2

(12) United States Patent
Ayeni

(10) Patent No.: US 10,577,153 B2
(45) Date of Patent: Mar. 3, 2020

(54) DISPOSABLE DUAL BEVERAGE HOLDING RECEPTACLE

(71) Applicant: Babatope Sewande Ayeni, Athens, OH (US)

(72) Inventor: Babatope Sewande Ayeni, Athens, OH (US)

( * ) Notice: Subject to any disclaimer, the term of this patent is extended or adjusted under 35 U.S.C. 154(b) by 442 days.

(21) Appl. No.: 15/270,888

(22) Filed: Sep. 20, 2016

(65) Prior Publication Data

US 2018/0079552 A1 Mar. 22, 2018

(51) Int. Cl.

| | |
|---|---|
| ***B65D 1/02*** | (2006.01) |
| ***B65D 1/16*** | (2006.01) |
| ***B65D 17/40*** | (2006.01) |
| ***B65D 21/02*** | (2006.01) |
| ***B65D 81/32*** | (2006.01) |
| ***B65D 17/28*** | (2006.01) |
| ***B65D 71/50*** | (2006.01) |

(52) U.S. Cl.

CPC ..... *B65D 21/0217* (2013.01); *B65D 1/0207* (2013.01); *B65D 1/0246* (2013.01); *B65D 1/165* (2013.01); *B65D 17/4012* (2018.01); *B65D 71/502* (2013.01); *B65D 81/3205* (2013.01); *B65D 2517/0049* (2013.01)

(58) Field of Classification Search

CPC .... B65D 1/0207; B65D 1/0246; B65D 1/165; B65D 17/4012; B65D 21/0217; B65D 21/0219; B65D 21/022; B65D 21/0222; B65D 21/0223; B65D 21/0224; B65D 21/0228; B65D 21/023; B65D 21/0231; B65D 71/502; B65D 81/3211; B65D 2517/0049; B65D 2517/005

USPC ..... 220/503

See application file for complete search history.

(56) References Cited

U.S. PATENT DOCUMENTS

| | | | | |
|---|---|---|---|---|
| 2,725,732 | A | 12/1955 | Julius Somoza | |
| 4,054,205 | A * | 10/1977 | Blow, Jr. | B65D 25/20 206/217 |
| 4,715,510 | A | 12/1987 | van der Meulen | |
| 4,883,192 | A | 11/1989 | Krugman | |
| 5,071,042 | A | 12/1991 | Esposito | |
| 5,180,079 | A * | 1/1993 | Jeng | A47G 19/065 206/217 |
| 5,738,921 | A * | 4/1998 | Andersen | B05B 11/0037 428/36.4 |
| 5,782,345 | A * | 7/1998 | Guasch | B65D 41/3409 206/219 |
| 5,839,596 | A | 11/1998 | Zahn | |
| 6,474,494 | B1 * | 11/2002 | Miller | A47G 19/065 206/217 |
| 6,706,297 | B1 * | 3/2004 | Toth | A47G 19/065 206/223 |
| 7,217,434 | B1 * | 5/2007 | Loh | B65D 81/3205 206/217 |

(Continued)

FOREIGN PATENT DOCUMENTS

| | | | | |
|---|---|---|---|---|
| NL | 1003854 C2 * | 2/1998 | | B65D 25/38 |

*Primary Examiner* — Joshua E Rodden

(57) ABSTRACT

A disposable dual beverage receptacle includes of at least two fluid retentive chambers. A top chamber and a bottom chamber, the top chamber is connected with the bottom chamber using its base connector. The base connector has mechanisms for mounting and dismounting the bottom chamber. The bottom chamber is a beverage can.

5 Claims, 22 Drawing Sheets

(56) References Cited

U.S. PATENT DOCUMENTS

| | | | | |
|---|---|---|---|---|
| 7,850,027 | B2 * | 12/2010 | Hayes | A61J 9/00 206/219 |
| 8,342,346 | B2 * | 1/2013 | Rances | B65D 21/083 220/23.83 |
| 8,365,960 | B1 | 2/2013 | Kalaouze | |
| 8,485,378 | B2 * | 7/2013 | Zoss | A47G 19/02 206/219 |
| 8,590,730 | B2 * | 11/2013 | Buck | B65D 81/3205 220/23.83 |
| 8,662,351 | B2 | 3/2014 | Kalaouze | |
| 8,815,318 | B2 * | 8/2014 | Zoss | B65D 51/247 206/219 |
| 8,939,312 | B1 * | 1/2015 | Buck | A47G 19/065 220/212 |
| 2003/0178433 | A1 | 9/2003 | Adams | |
| 2004/0099674 | A1 * | 5/2004 | McDonough | A47G 19/2272 220/714 |
| 2005/0098561 | A1 * | 5/2005 | Schwoebel | B65D 17/4012 220/258.1 |
| 2008/0302795 | A1 | 12/2008 | Berglund | |
| 2011/0290805 | A1 * | 12/2011 | Rances | B65D 21/083 220/529 |
| 2013/0146592 | A1 | 6/2013 | Kalaouze | |
| 2015/0136774 | A1 * | 5/2015 | Shemesh | B65D 41/12 220/258.3 |
| 2016/0015198 | A1 * | 1/2016 | Choi | A47G 19/2255 206/216 |
| 2018/0079552 | A1 * | 3/2018 | Ayeni | B65D 21/0217 |
| 2019/0008296 | A1 * | 1/2019 | Suprina | B65D 11/04 |

* cited by examiner

DISPOSABLE DUAL BEVERAGE HOLDING RECEPTACLE

FIELD OF THE INVENTION

The present invention relates to bottles. More particularly, it is related to bottles having dual compartments or chambers for holding two different liquids or beverages and for selectively dispensing beverages.

BACKGROUND OF THE INVENTION

Prior Art

The following is a tabulation of some prior art that presently appear relevant.

| Patent no. | Issue Date | Patentee |
|---|---|---|
| 47,157,510 | Dec. 29, 1987 | Leendart Van der Meulen |
| 4,883,192 | Nov. 28, 1989 | Robert Krugman |
| 8,365,960 B1 | Feb. 5, 2013 | Fadi Kalaouze, |

Description of the Prior Art

Dual chamber or compartment bottles have always existed. These multiple compartment or chamber bottles give consumers access to plurality of liquids. These multiple chamber bottles can contain dissimilar liquids for example pre-workout drinks or energy drinks in one chamber and electrolyte drinks for rehydration or protein drink in the other. This enables the consumer to have access to energy drink or pre workout drink to boost their workout or exercise and access to post workout or recovery drink such as protein. These drinks could contain vitamins, minerals, protein supplements and electrolytes.

Various dual chamber receptacles have been invented and patented. Examples of such receptacles may be found in U.S. Pat. No. 47,157,510 to Leendart Van der Meulen wherein the invention relates to a set up piece for mounting on a can, containing a beverage. In the lid of such a can a substantially triangular opening can be made by tearing a part of the lid away by means of a riveted ring and an impressed rill.

U.S. Pat. No. 4,883,192 to Robert Krugman wherein the device provides a bifunctional reusable container closure and drinking spout for pressurized liquids. The invention utilizes a funnel-shaped body having a screw capped pouring spout on one end and an annular skirt on the other end. The skirted end snap fits over an opened standard soda or beer can.

U.S publication no. US 20030178433A1 drawn to a beverage container has a lower container section filled with a first liquid. Above the lower container section is an upper container section secured to the lip and groove of the lower section. The upper container section can hold a second different liquid than the first liquid. The upper section defines a mixing channel where openings to both the upper and lower container sections meet to allow the two liquids to mix prior to final dispensation.

I discovered that many of these receptacles are not compact as they have multiple parts. They are also difficult to snap fit on a beverage can and they are hard to dismount. This problem of compatibility has been solve by reducing the number of parts and by using a more efficient manufacturing process. The difficulty of snap fitting the device on the beverage can has been solved in the present invention by the implementation of mechanisms at the base which causes the bottom of the receptacles to exhibit a spring like displacement. The spring like mechanism also makes the receptacle able to withstand physical challenges in the market place. For instance, the mechanism will prevent the dual beverage holding receptacle from accidental disassemble when dispensed from a vending machine.

Advantages

Accordingly, several advantages of one or more aspects are as follows: to provide a compact and easy-to-use disposable dual bottle that is easy to manufacture, easy to handle, easy to dispose and with more aesthetics. Other advantages of one or more aspects will be apparent from a consideration of the drawings in ensuing descriptions.

DESCRIPTION OF THE NUMERALS

10 Threaded cap

12 Cap thread

Figure 1:
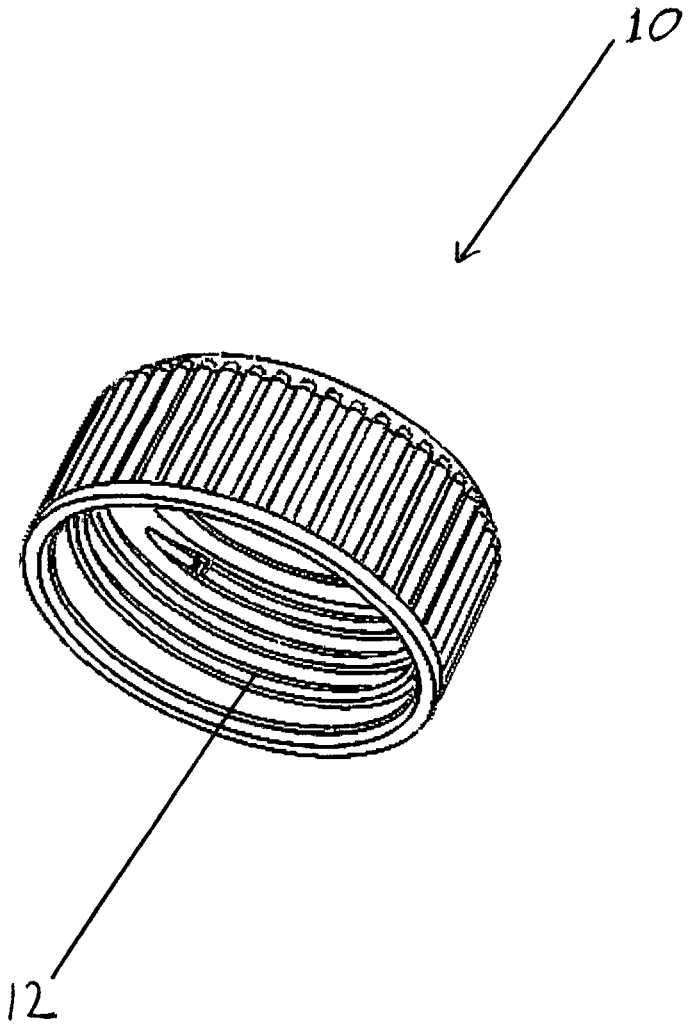
FIG. 1 is a perspective view of the threaded bottle cap.

20 Bottomless Top
22 bottomless top thread
24 Top opening
26 Rim
28 Open bottom
30 base connector
32 Flange
34 Base connector Collar
36 Gap
38 Tab
40 Hooking lips
42 base connector partition
44 Slit
46 Circular support.
50 Bottomless top and base connector
60 Top Chamber
70. Assembled top chamber
80 Section view of top the top chamber
90 Beverage can serving as the bottom chamber
92 Push tab
94 Beverage can rim
100 Complete assembly of top chamber with beverage can; Disposable dual beverage holding receptacle.
110 Interlock of Top chamber and beverage can.
120 Exploded view of the disposable dual beverage holding receptacle with a beverage can.
130 Exploded view of the top chamber with a container.
132 Thin foil for sealing cup the opening on the container.
134 Container
136 Container rim
138 Container opening
140 Cap
142 Cap thread
144 Mixing chamber
160 Base connector with an elongated hollow section
162 Elongated hollow part
164 Opening on elongated hollow section
168 Flange
166 hooking lips
170 Thin sheets of material
172 Edge of thin sheets of material
180 Foil, bottomless top and base connector with an elongated hollow section.
190 Section view of the complete assembly of top chamber and cap with mixing chamber.
200 Complete assembly of disposable dual beverage holding receptacle, a hollow elongated part, a cap with a mixing chamber and a beverage can.

DESCRIPTION OF THE INVENTION

Figure 2:
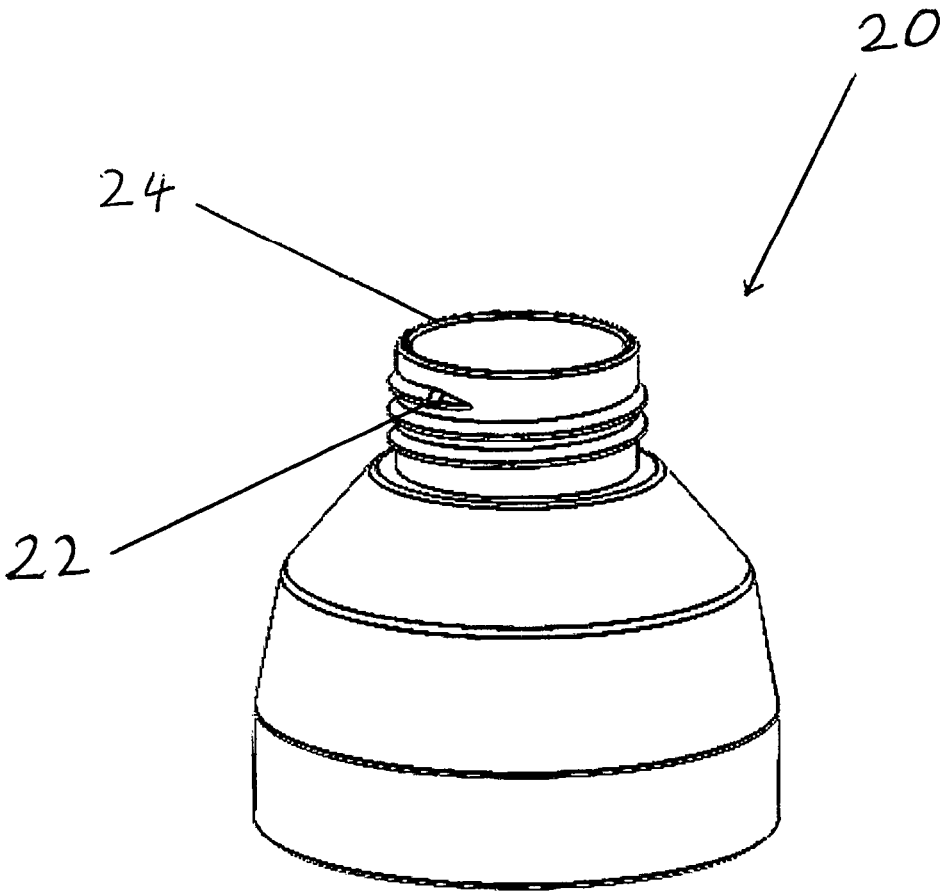
FIG. 2 is a perspective view of the bottomless top chamber.
Figure 3:
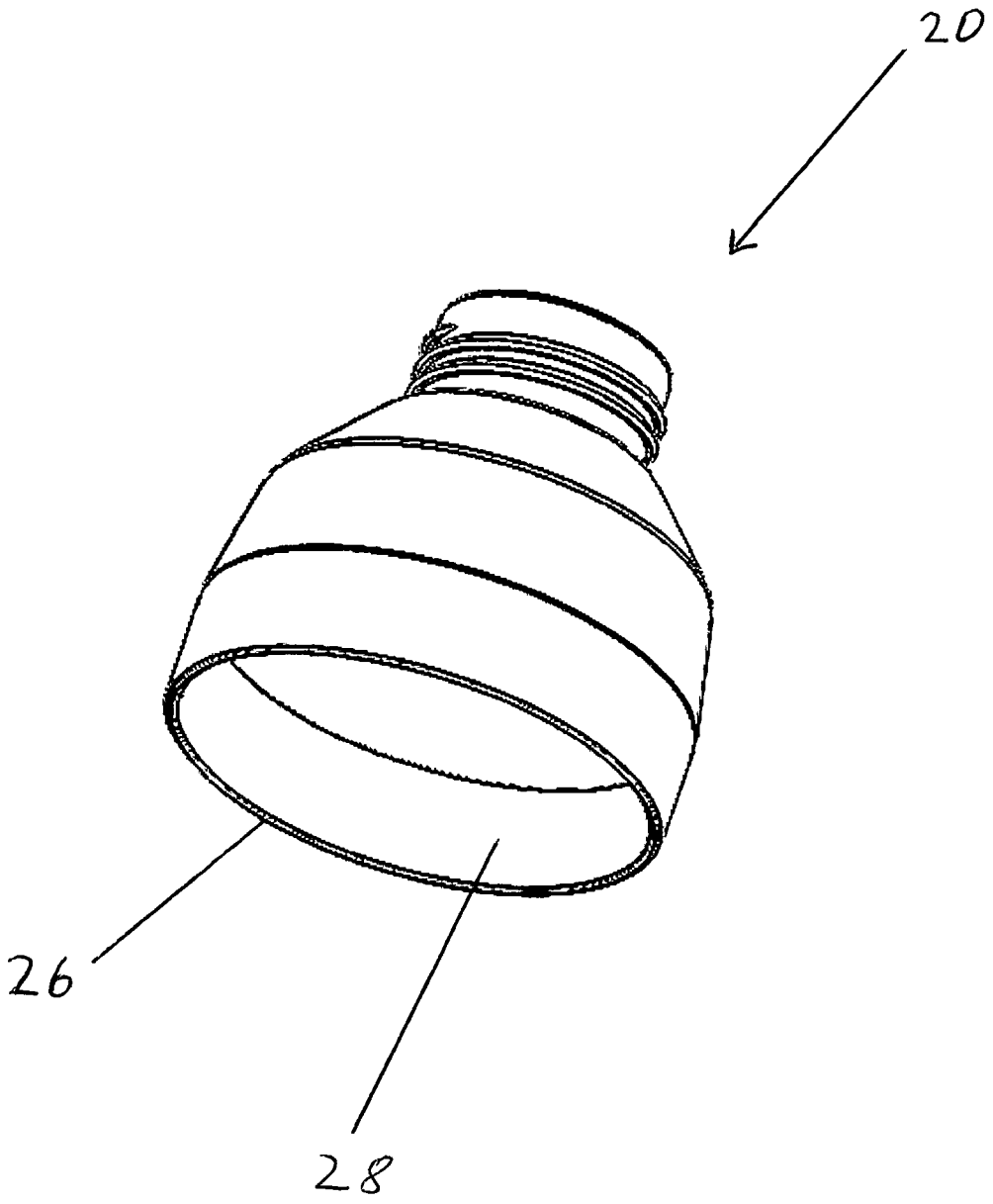
FIG. 3 is a perspective view showing the bottomless top showing the opening at the bottom.
Figure 4:
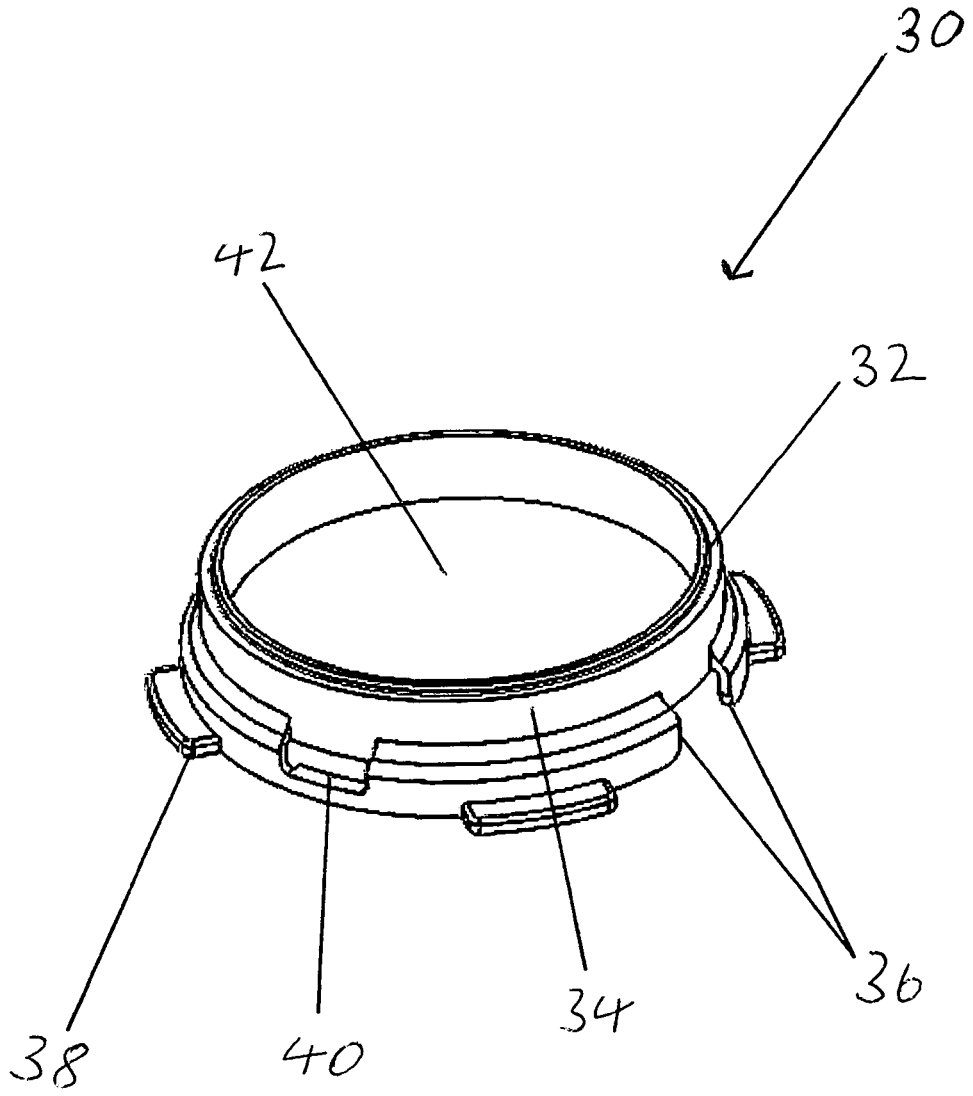
FIG. 4 is a perspective view of the chamber connector showing the top.
Figure 5:
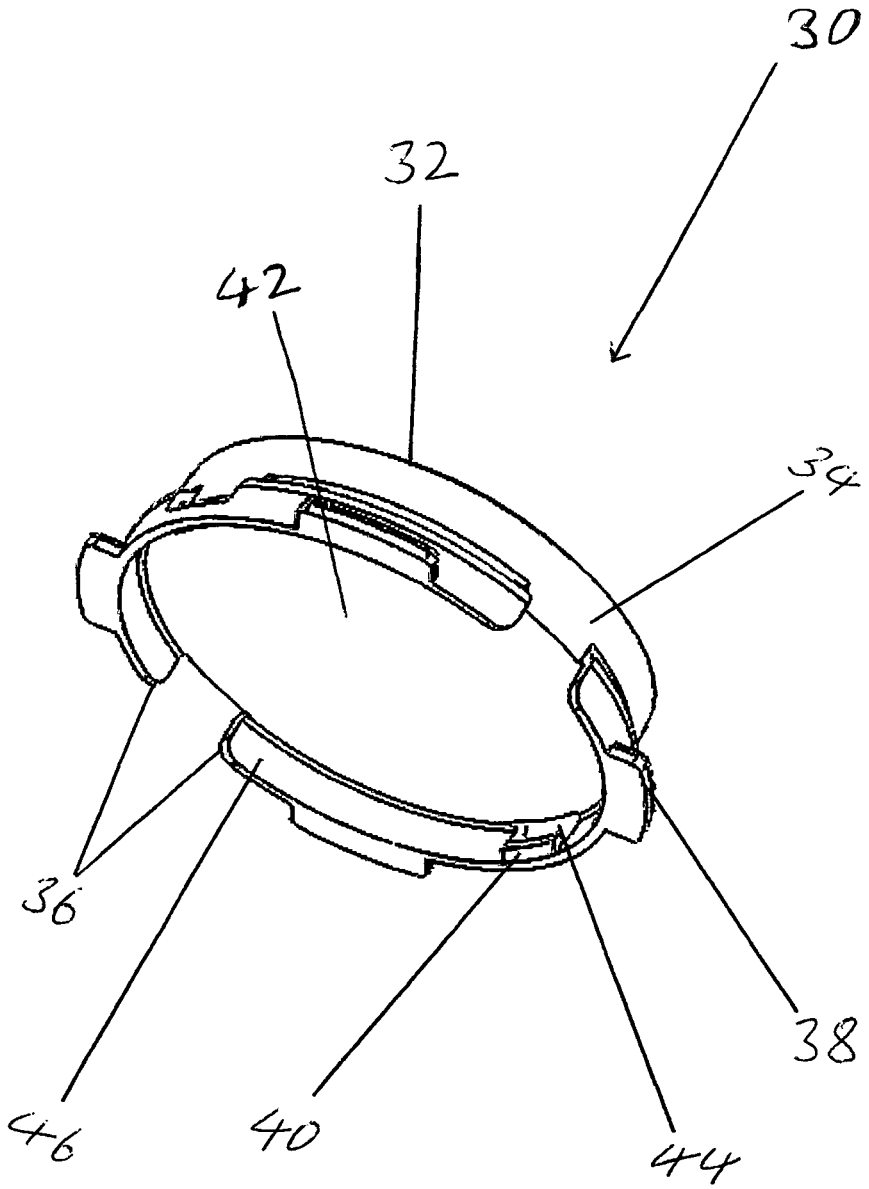
FIG. 5 is a perspective view of the chamber connector showing the bottom.
Figure 6:
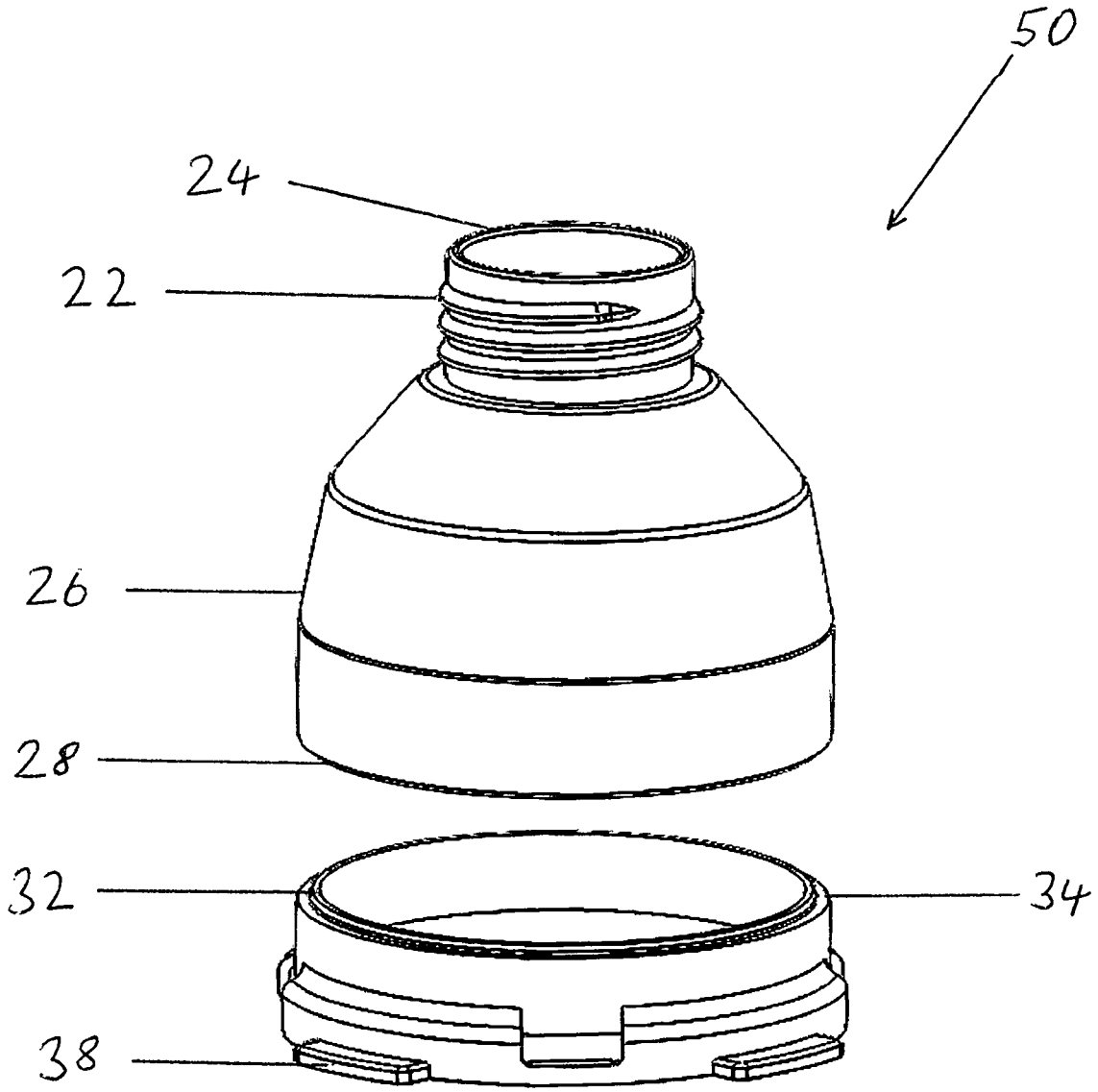
FIG. 6 is a perspective view of the bottomless top with the base connector.
Figure 7:
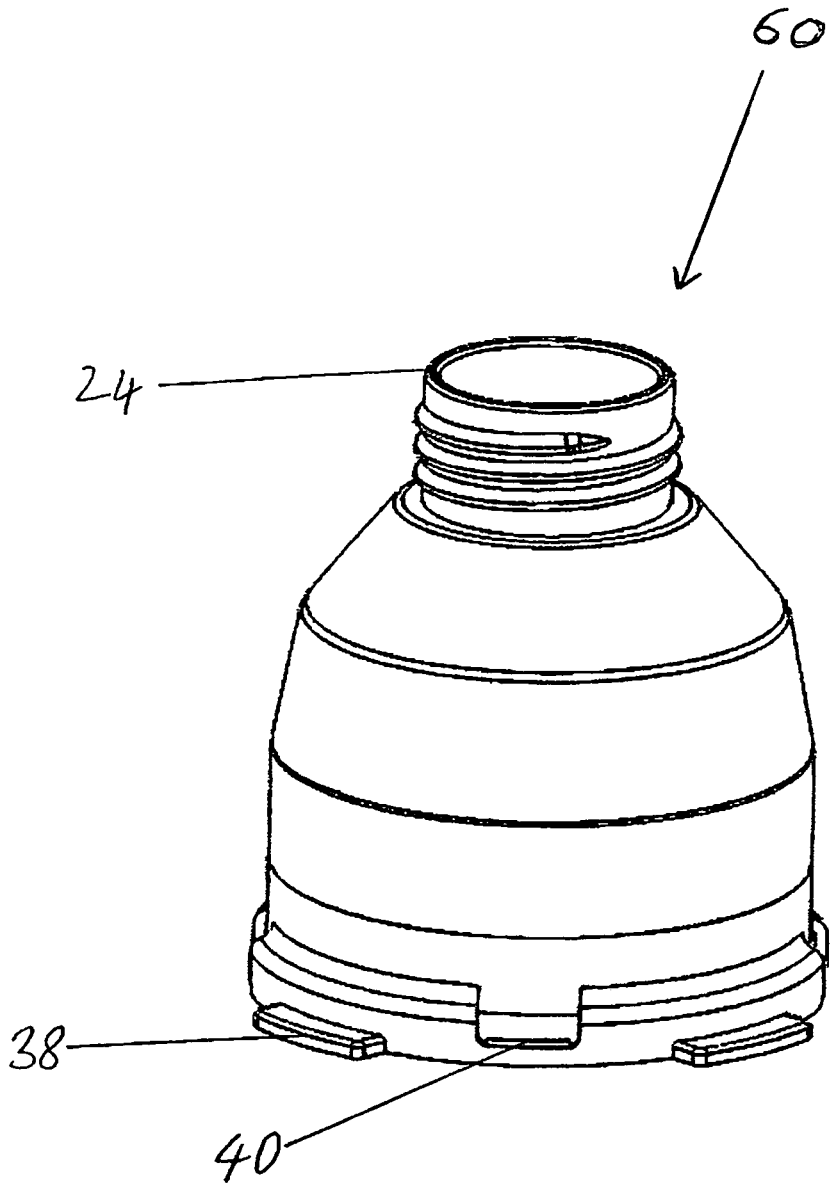
FIG. 7 is a perspective view of the top chamber.
Figure 11:
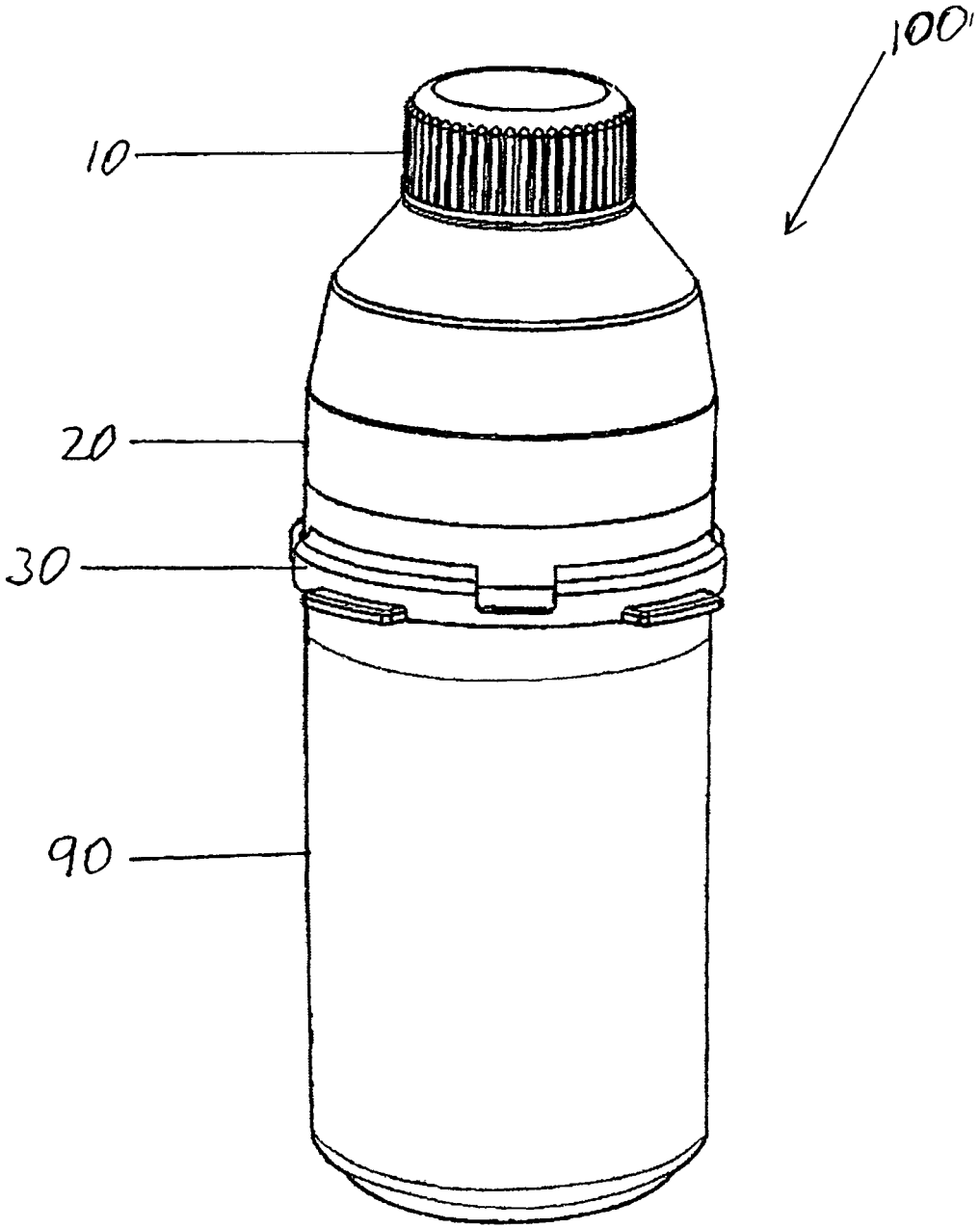
FIG. 11 Perspective view of the disposable dual chamber bottle with a beverage can.

FIG. 11 is a complete assembly of disposable dual beverage holding receptacle 100. The assembled top chamber 70 (FIG. 8) can be made of made of materials such as high-density polyethylene, polypropylene or ABS plastic (Acrylonitrile Butadiene Styrene). ABS plastic material may be used in the manufacturing of this invention because of the strength, to ensure better sealing and to prevent leakage. Amongst all plastics, ABS is the easiest to weld together using ultrasonic welding and this helps to produce a tight leak-proof seal. FIG. 2 is a perspective view of the bottomless top 20 with top opening 24 (FIG. 2) and open bottom 28 (FIG. 3). FIG. 4 is a perspective view of the base connector 30 having flange 32 on base connector collar 34. The threaded cap 10 and bottomless top 20 and base connector 30 are all injection molded. Base connector 30 is injection molded in one piece with no assembled parts. The bottomless top 20 is ultrasonically welded to base connector 30 by placing rim 26 on base connector collar 34 (FIG. 6) and flange 32 supports and maintains the alignment of these two parts in appropriate relative positions during the ultrasonic welding process. These two welded parts; bottomless top 20 and chamber connector 30 form the top chamber 60 (FIG. 7). Thus, opening 28 on bottomless top 20 is enclosed by fluid retentive chamber partition 42 on base connector 30. This assemblage forms a fluid retentive top chamber 60.

Figure 8:
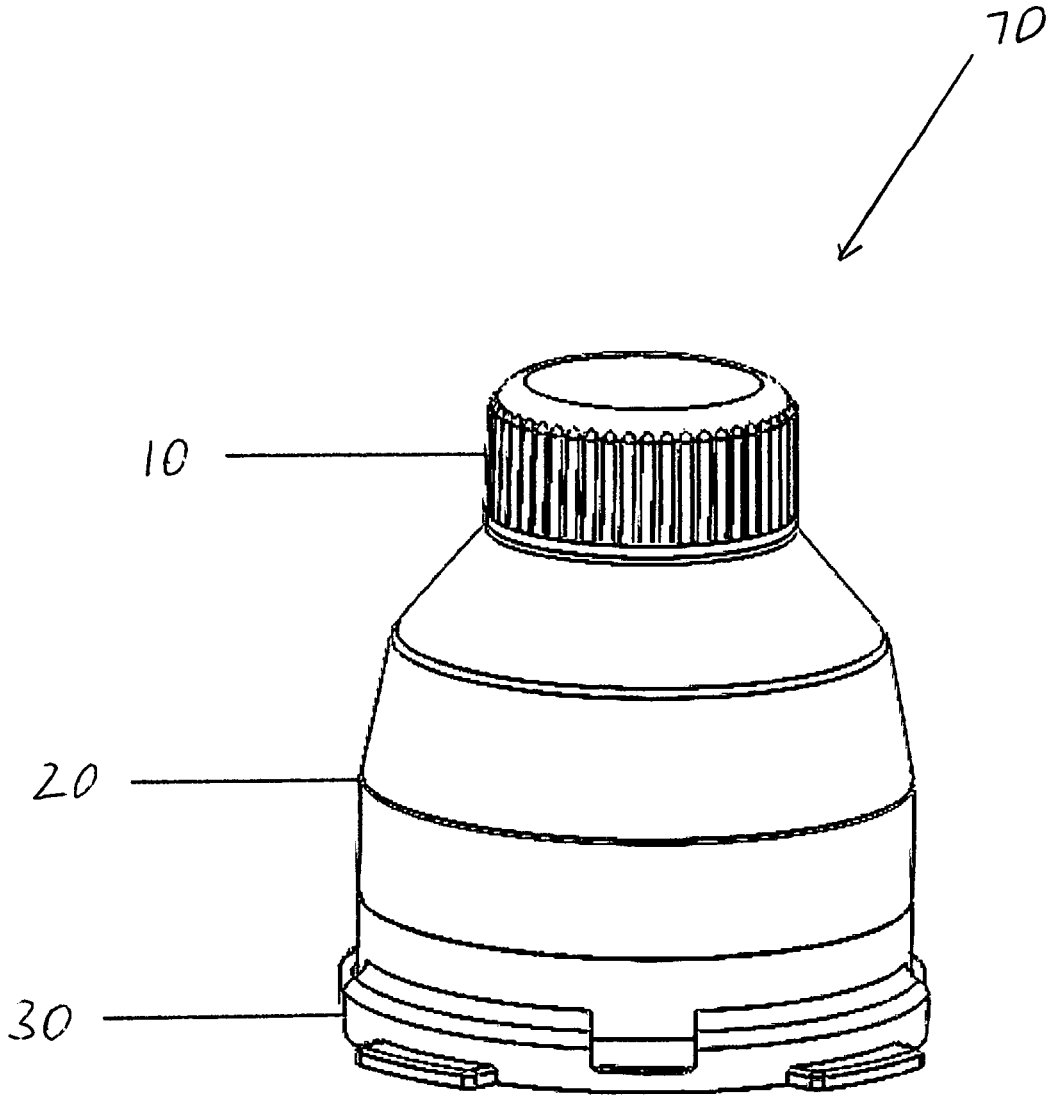
FIG. 8 is a complete assembly of the top chamber.
Figure 9:
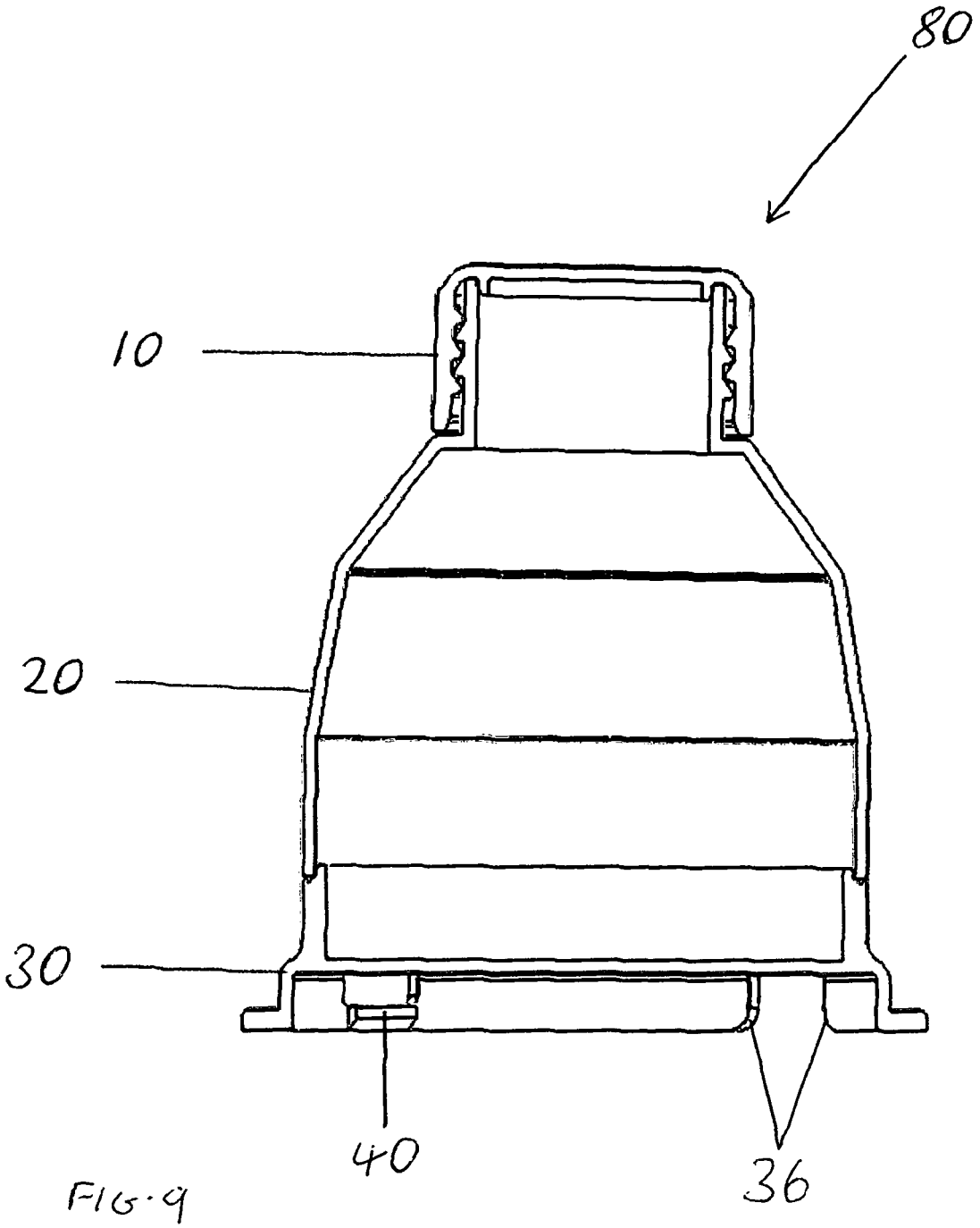
FIG. 9 is a cross-sectional view of the top chamber.
Figure 10:
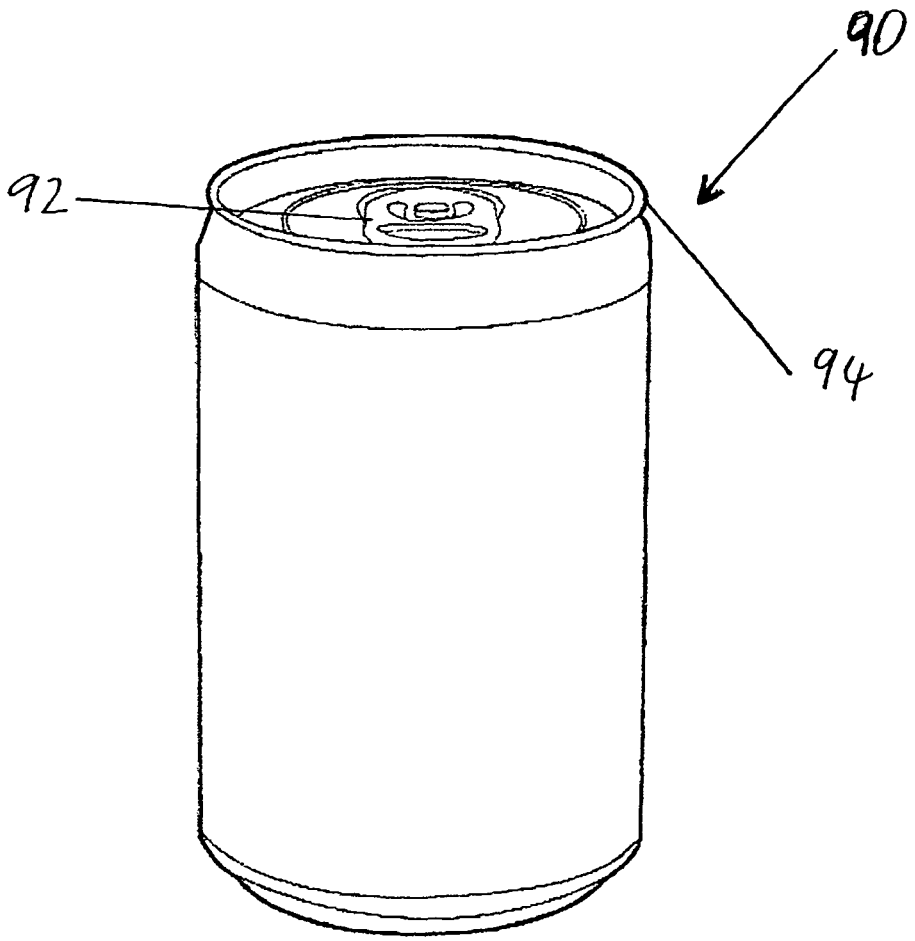
FIG. 10 Perspective view of the beverage can with flip top serving as the bottom chamber.
Figure 12:
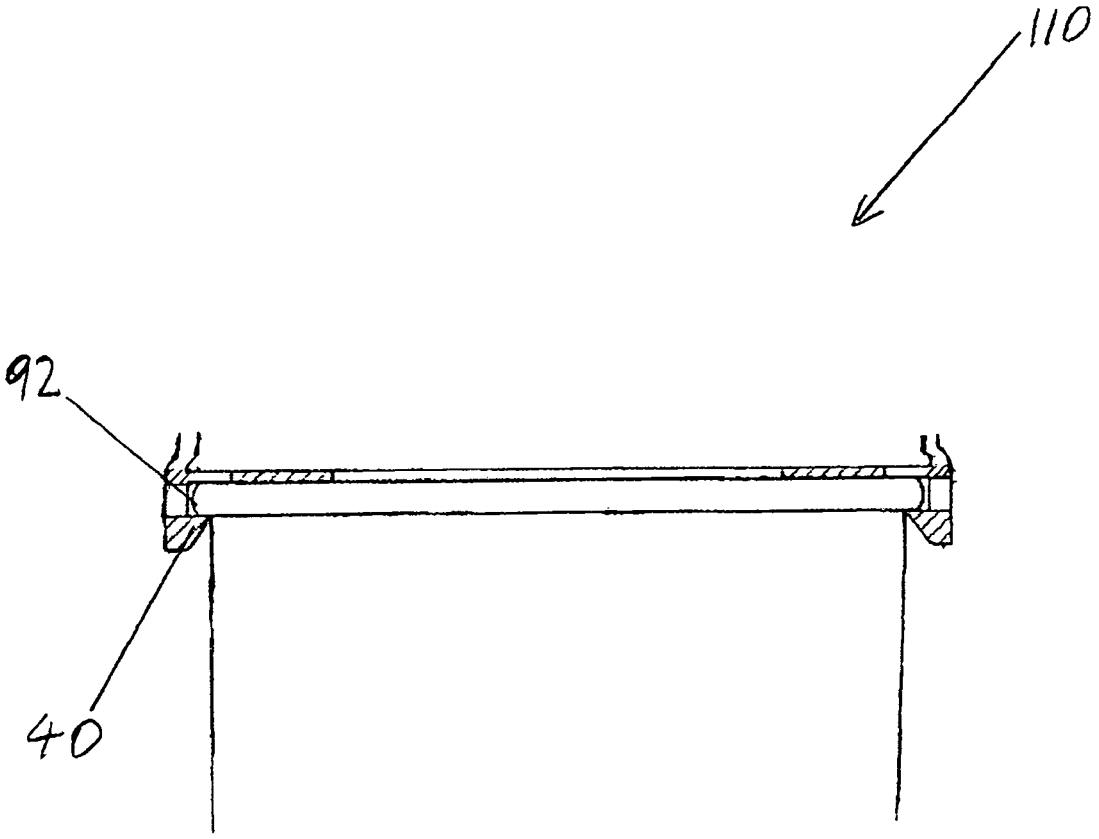
FIG. 12 is a cross-sectional view of the disposable dual chamber bottle showing the interlock.
Figure 13:
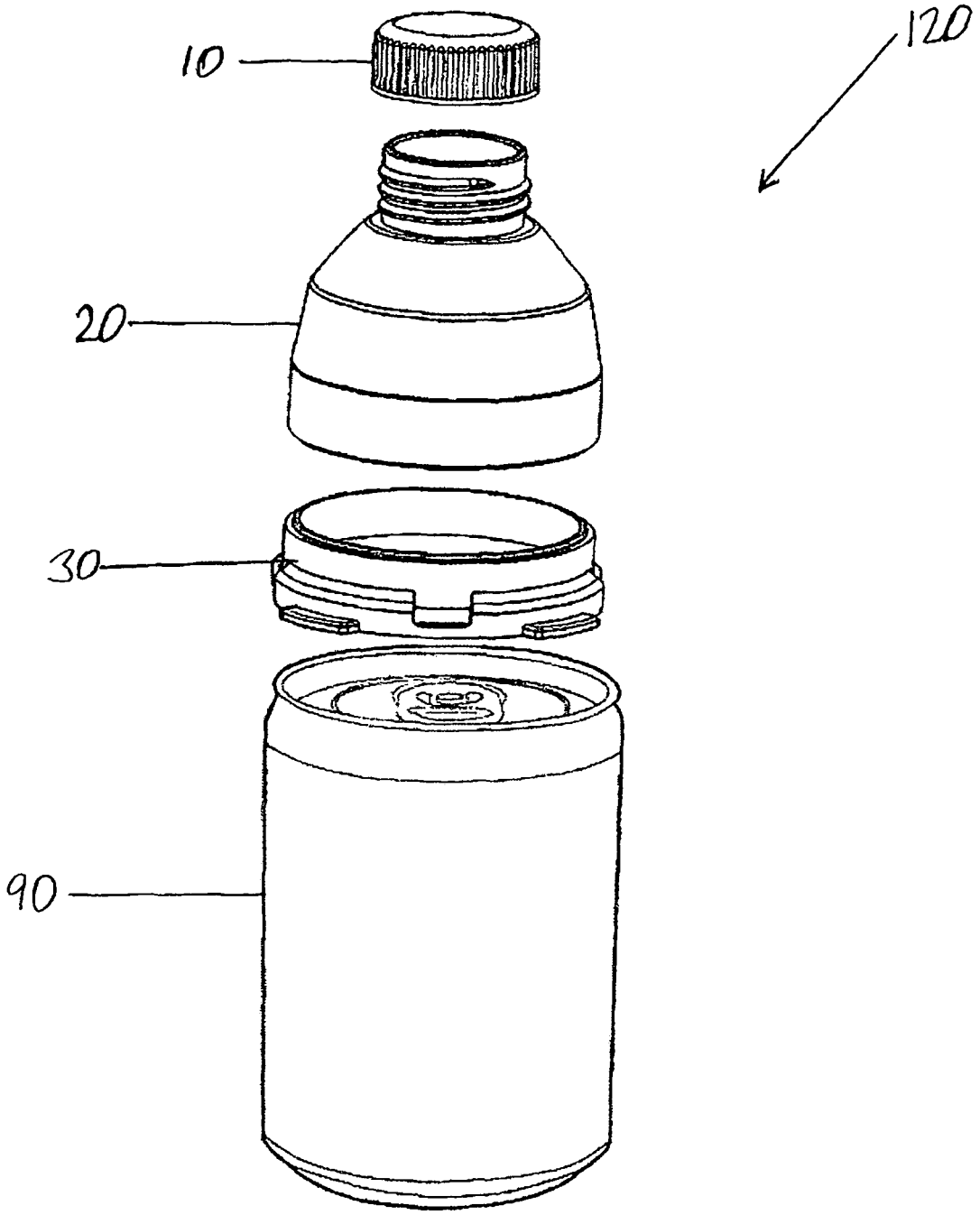
FIG. 13 is an exploded view of the disposable dual chamber bottle.

Top chamber 60 is then filled with a sport drink such as pre workout drink or energy drink through opening 24 and then threaded bottle cap 10 is applied on chamber 60 at opening 24 to secure the drink in assembled top chamber 70 (FIG. 8). Beverage can 90 (FIG. 10.) is prefilled with a post workout drink such as a protein drink or and electrolyte drink. The beverage can 90 is the bottom chamber. The base connector 30 has a circular support 46. The circular support 46 has two gaps 36 and four hooking lips 40. Assembled top chamber 70 is then snapped on, fitted and mated with the prefilled beverage can 90 at rim 94 (FIG. 12). The downward force applied on the beverage can 90 by the fitting assembled top chamber 70 slightly displaces circular support 46. The hooking lips also slightly and resiliently recede backward just to tightly engage and mate with the underside of rim 94 on beverage can 90. When the downward force is applied on the beverage can 90, gaps 36 on circular support 46 and slits 44 above hooking lips 40 brings about a spring-like displacement of the circular support 46 which in turn enables the hooking lips 40 to tightly engage and mate with the underside of rim 94 on beverage can 90. This spring-like mechanism comprises of the circular support 46, gaps 36, slits 44 and hooking lips 40. During mass production, these spring like mechanism makes it easy to snap-fit or interlock assembled top chamber 70 onto the beverage can 90 without putting much pressure on the beverage can and risking crushing the can. The mechanism also helps the consumer to easily detach the assembled top chamber 70 from beverage can 90 by pushing on chamber tabs 38.

Operation

In operation, before doing any physical exercise a user will remove the threaded bottle cap 10 on disposable dual beverage holding receptacle 100 to drink the pre workout drink or energy drink. To remove and dispose the empty top chamber 70, the user will push on chamber tabs 38 thus, simultaneously disengaging the hooking lips 40 from the underside of the rim 94. The chamber tabs helps the user to get a good grip on the bottle when holding the bottle and to remove the top chamber 70. After a physical exercise, to drink the post workout drink in the beverage can, the user pushes the tab 92 on the prefilled beverage can 90 to create an opening to dispense the drink. The empty can is then disposed. The disposable dual beverage holding receptacle can hold any kind of liquid beverage. The use of this invention is not limited to carrying sport drinks alone.

Figure 14:
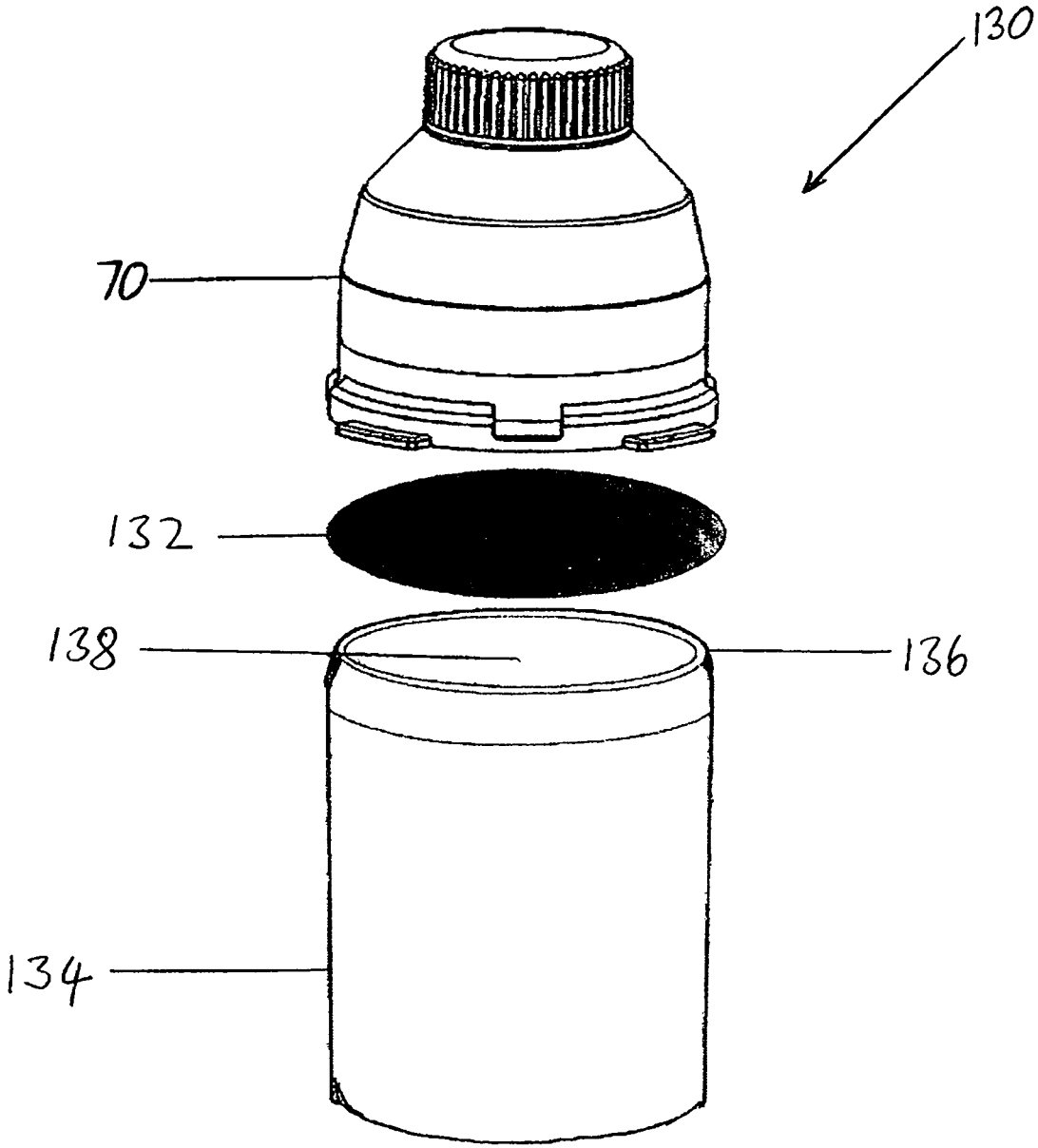
FIG. 14 Shows an exploded view of the disposable dual beverage holding receptacle with a container as the bottom chamber.
Figure 20:
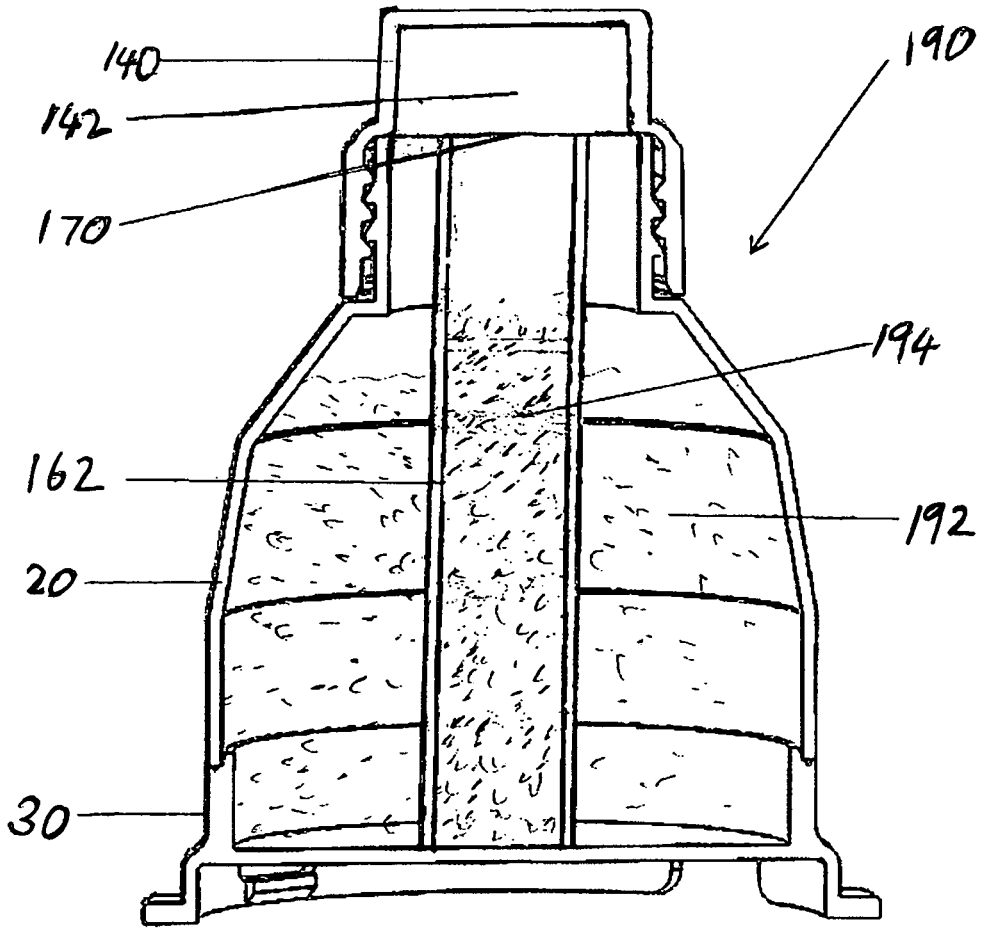
FIG. 20 shows a cross-sectional view of the top chamber with a cap with a mixing chamber.

FIG. 14, FIG. 20 Alternative Embodiments

There are various possibilities with regard to the design of the disposable dual beverage holding receptacle. FIG. 14 shows a disposable dual beverage holding receptacle with a container 136 sealed with thin sheet of material 132 at rim 136 to secure the drink. The container 136 replaces the beverage can 90. The container could be made of plastic or metallic material.

Figure 15:
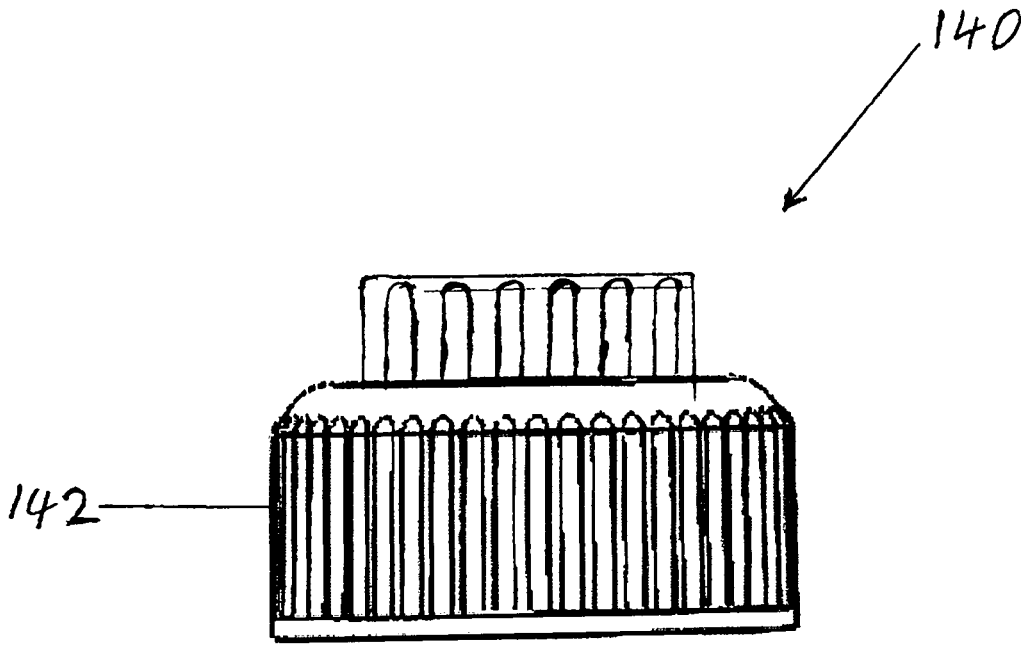
FIG. 15 shows a front view of a cap with a mixing chamber.
Figure 16:
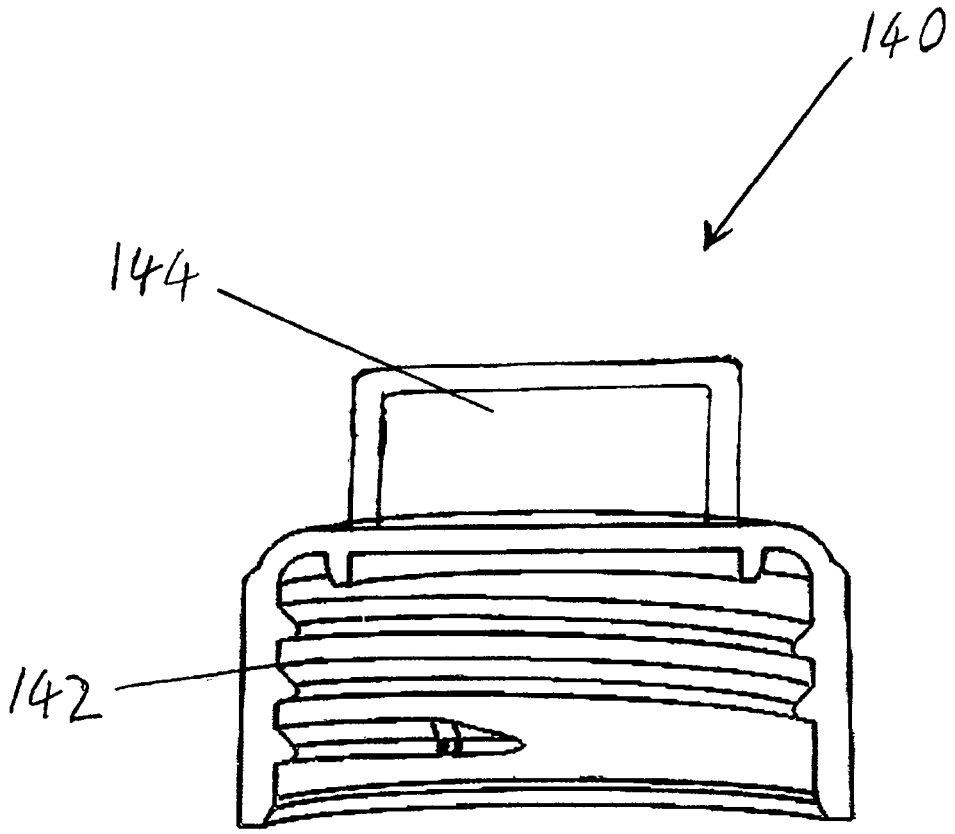
FIG. 16 shows a cross-sectional view of a mixing chamber.
Figure 17:
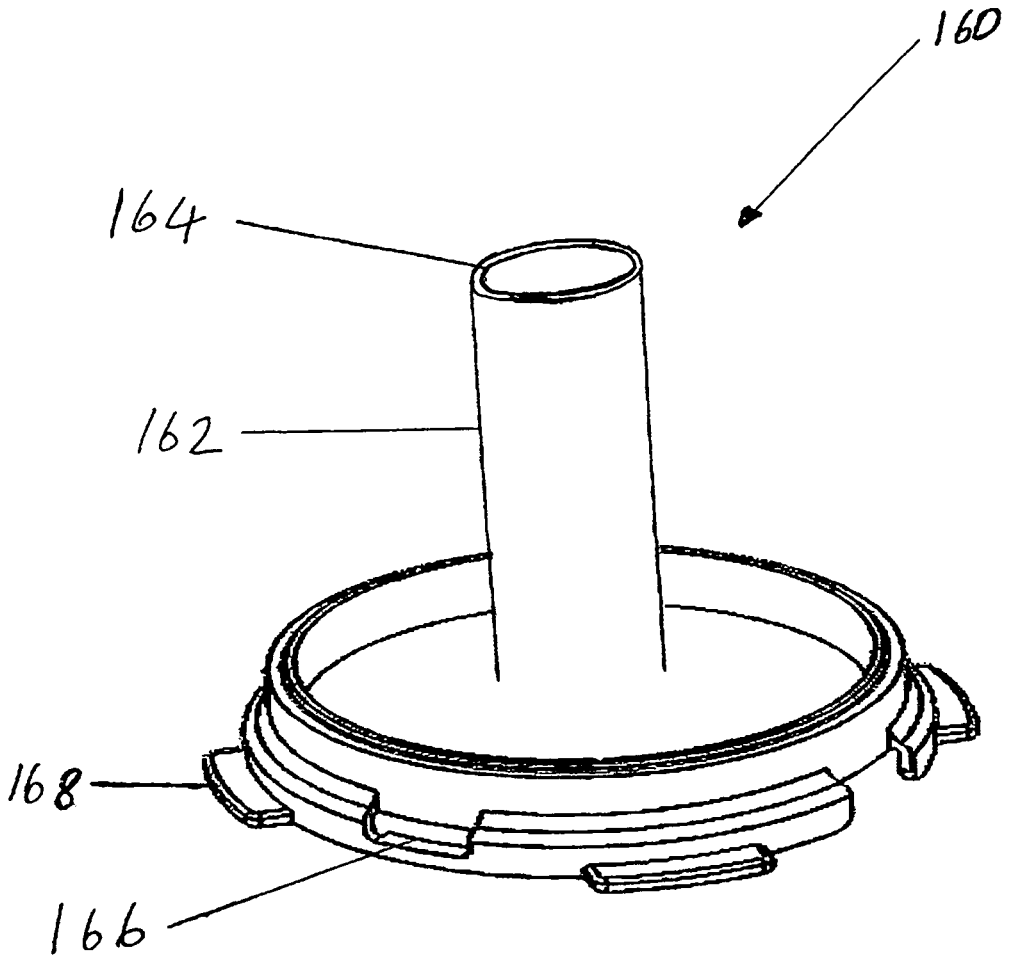
FIG. 17 shows a perspective view of a base connector with an elongated hollow section.
Figure 18:
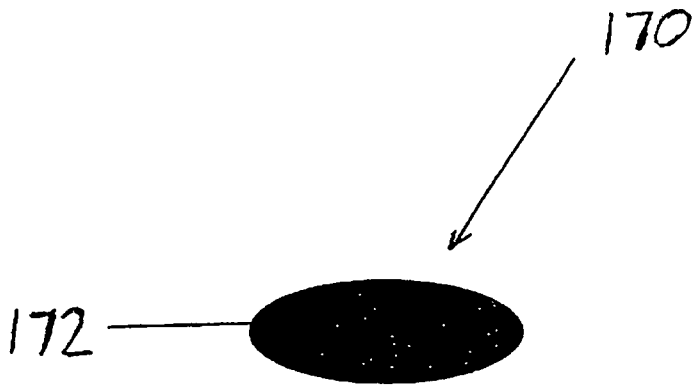
FIG. 18 is a perspective view of a sealing thin sheet of material.
Figure 19:
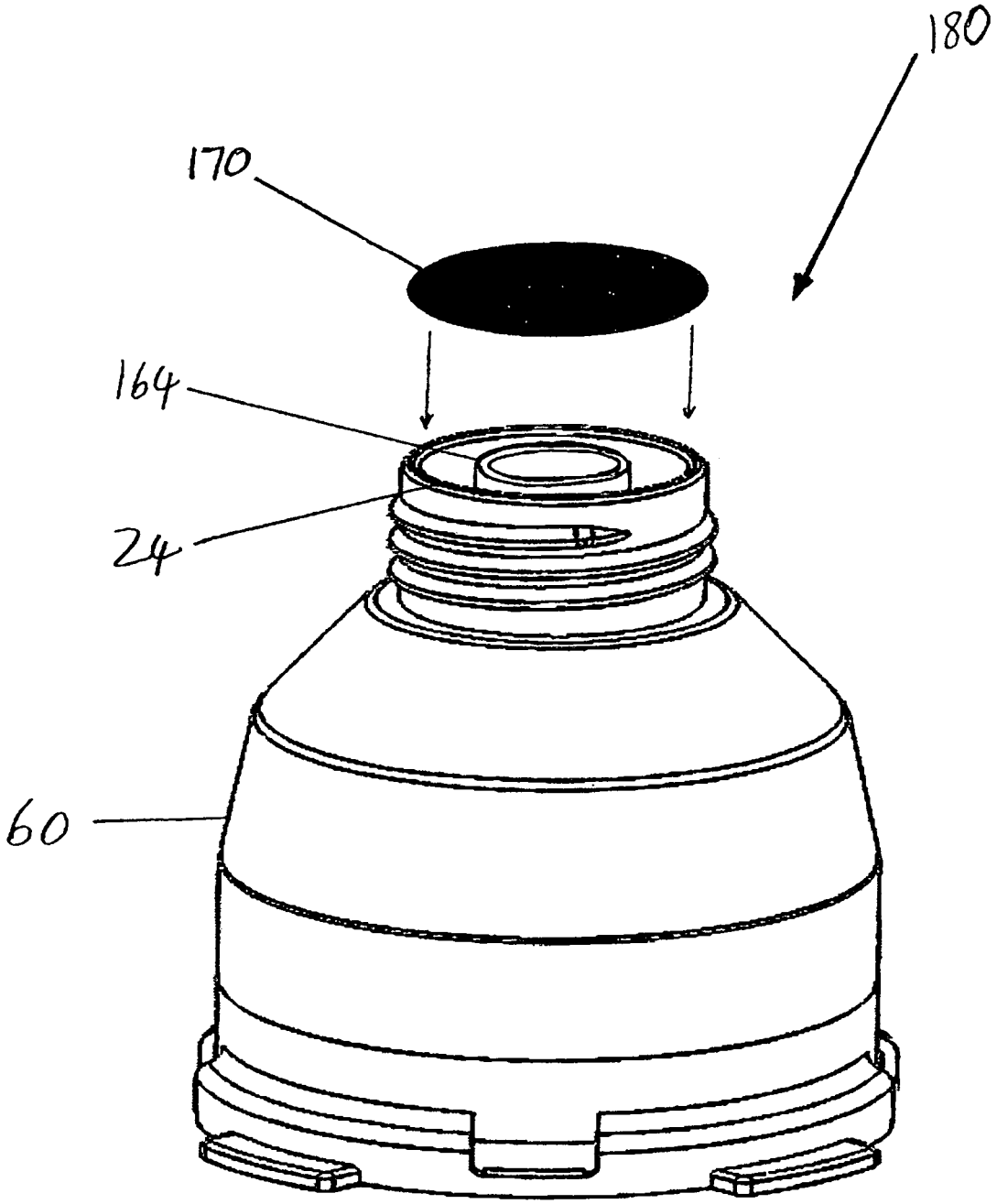
FIG. 19 is a perspective view of top chamber with chamber connector having an elongated hollow section and a sealing thin sheet of material.
Figure 21:
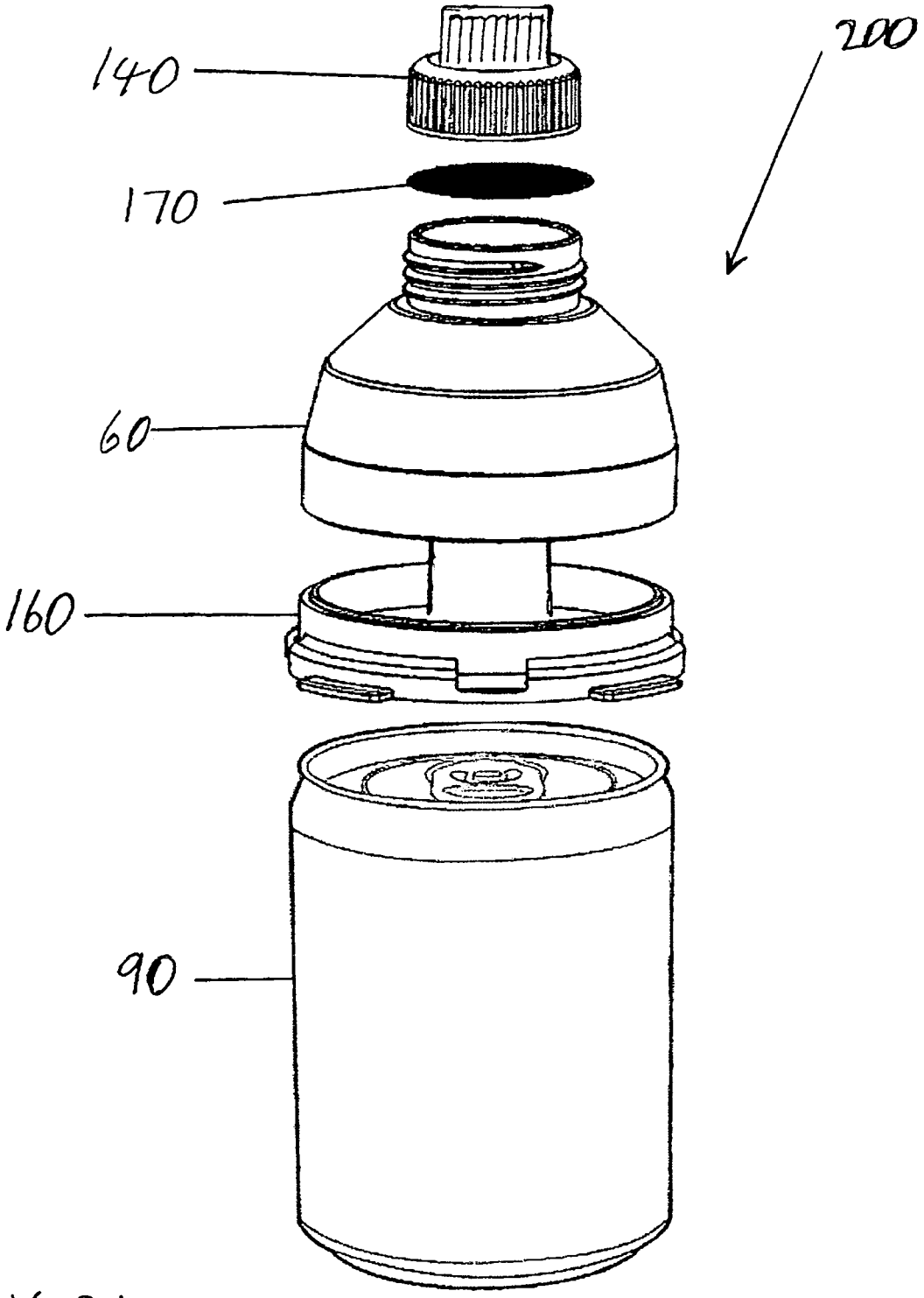
FIG. 21 illustrates an exploded view of top chamber, cap with mixing chamber, thin foil, chamber connector with elongated hollow section and a beverage can.
Figure 22:
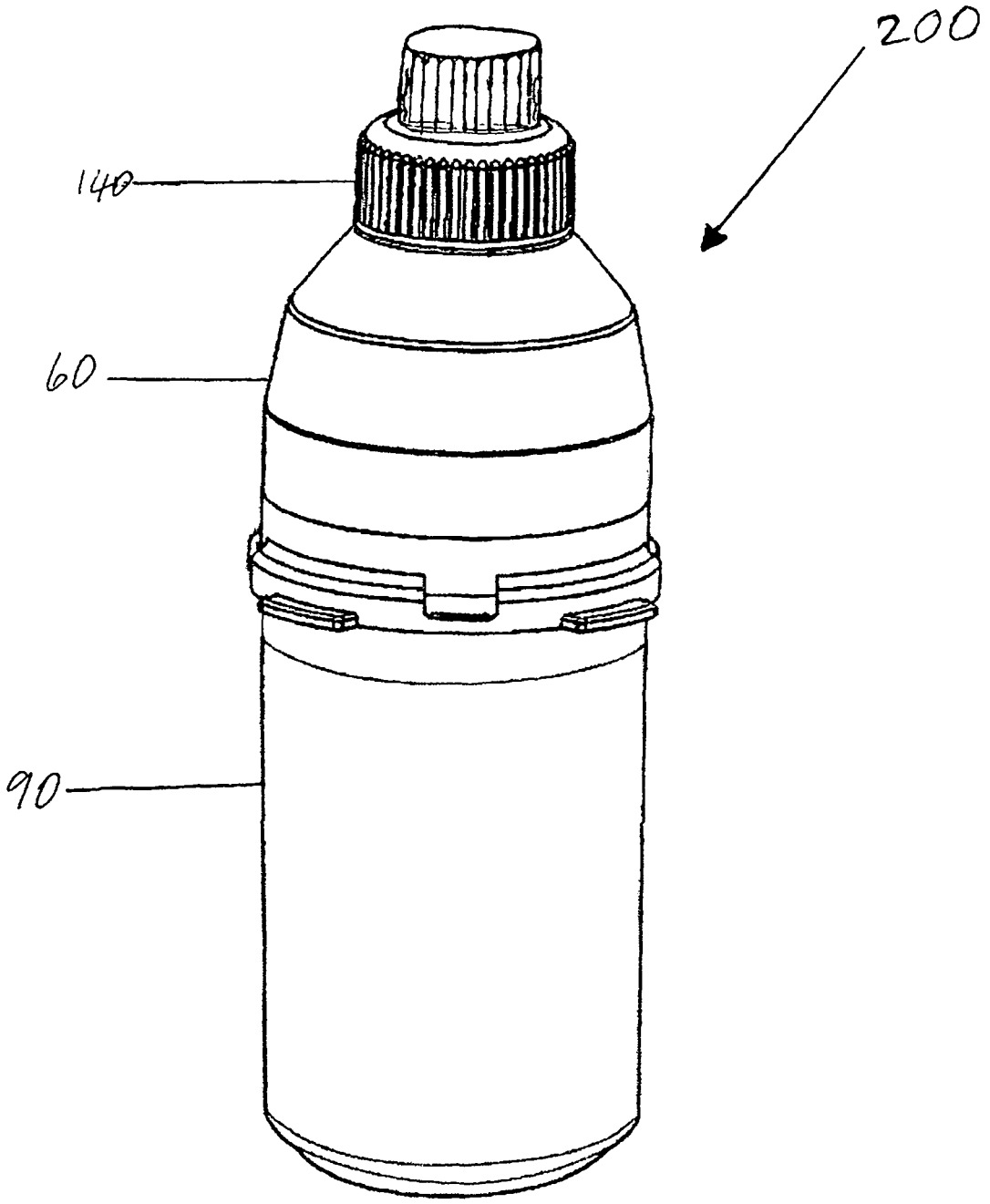
FIG. 22 shows an assembly of disposable dual chamber bottle with a beverage can and a cap with a mixing chamber.

FIG. 17 shows a chamber connector 160 with an elongated hollow section 162. The elongated hollow section 162 has no opening at the bottom and it is filled with a powdered pre workout supplement 194 or a pre workout liquid concentrate (FIG. 20). Top chamber assembly 190 is filled with water or a mixing drink 192 and a thin sheet of material 170 is placed on and sealed on top chamber assembly 180 in such a manner that it covers elongated hollow section 162 at opening 164 (FIG. 19) and simultaneously registers edge of thin sheet of material 172 with opening 24. The sealing process used is the induction sealing process. The thin sheets of material 170 keeps the powdered pre workout drink 194 or liquid concentrate intact in elongated hollow section 162 and it keeps water or mixing drink 192 held intact in the dual chamber assembly 190 (FIG. 20). The thin sheets of material 170 can be made of plastic or aluminum foil. A threaded cap 140 with a mixing chamber 144 is provided (FIG. 15) and it is used to cap the receptacle. To drink from the bottle, the user removes cap 140 and the thin sheet of material 170 is removed by peeling it off. The cap 140 is then screwed back on the top chamber assembly 190 and the user shakes top chamber assembly to allow the mixing of the powdered drink 194 or liquid concentrate and water or drink 192 to form a diluted solution of pre workout drink or energy drink. The mixing chamber 144 provides a space for these two materials to mix together evenly. FIG. 21 shows an exploded view of a complete assembly of disposable dual beverage holding receptacle, a hollow elongated part 162, cap 140 with a mixing chamber 144 and a beverage can 90.

As to a further discussion of the manner of usage and operation of the present invention, the same should be apparent from the above description. With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described.

The invention claimed is:

1. A disposable dual beverage holding receptacle comprising:

(a) a hollow material with two open ends: a top opening on top of said hollow material and a bottom opening at a bottom of said hollow material, said hollow material has a predetermined cross-sectional shape, (b) and a prefabricated base connector having a predetermined cross-sectional shape, having connector collar, and circular support, a top of said connector collar protrudes into a flange, said base connector is adapted to support and enclose said hollow material at said bottom opening whereby said flange is fitted into an underside of said bottom opening on said hollow material thereby providing alignment, whereby said base connector and said hollow material are ultrasonically welded, said base connector is adapted to be mounted on a pre filled beverage can, said base connector have at least one push tab, at least two hooking lips, said hooking lips are on the reverse side of said push tab, (c) the at least one push tab, and the at least two hooking lips forming a means of mounting and dismounting said beverage holding receptacle on said beverage can whereby said base connector removably mates with a top of said pre filled beverage can.

2. The disposable dual beverage holding receptacle of claim 1 is made of a resilient Acrylonitrile Butadiene Styrene plastic material.

3. The disposable dual beverage holding receptacle of claim 1 wherein said top opening has male threads and enclosed with a cap with female threads.

4. The disposable dual beverage holding receptacle of claim 1 wherein said prefabricated base connector having predetermined dimensions has at least one gap and at least one slit.

5. The disposable dual beverage holding receptacle of claim 1 wherein said means for mounting enables the circular support to exhibit a spring like displacement when said hooking lips are pressed on a rim on said beverage can, thereby said hooking lips tightly grips an underside of said rim on said beverage can thus creating an interlock.

* * * * *